US011680780B2

(12) United States Patent
Hoang et al.

(10) Patent No.: US 11,680,780 B2
(45) Date of Patent: Jun. 20, 2023

(54) PYROTECHNIC INITIATOR DEVICE

(71) Applicant: VIETTEL GROUP, Ha Noi (VN)

(72) Inventors: Minh Tuan Hoang, Ha Noi (VN); Manh Cuong Tran, Ha Noi (VN); Thanh Cong Le, Ha Noi (VN); Xuan Doan Dang, Ha Noi (VN); Tien Hoa Nguyen, Ha Noi (VN); Van Hoa Le, Ha Noi (VN)

(73) Assignee: VIETTEL GROUP, Ha Noi (VN)

( * ) Notice: Subject to any disclaimer, the term of this patent is extended or adjusted under 35 U.S.C. 154(b) by 74 days.

(21) Appl. No.: 17/316,349

(22) Filed: May 10, 2021

(65) Prior Publication Data

US 2022/0003528 A1 Jan. 6, 2022

(30) Foreign Application Priority Data

Jul. 6, 2020 (VN) ..... 1-2020-03930

(51) Int. Cl.

| | |
|---|---|
| ***F42B 3/11*** | (2006.01) |
| ***C22C 38/40*** | (2006.01) |
| ***F42B 3/12*** | (2006.01) |
| ***C22C 19/05*** | (2006.01) |
| ***C22C 5/04*** | (2006.01) |
| ***C06C 9/00*** | (2006.01) |

(52) U.S. Cl.

CPC ..... *F42B 3/11* (2013.01); *C06C 9/00* (2013.01); *C22C 5/04* (2013.01); *C22C 19/058* (2013.01); *C22C 38/40* (2013.01); *F42B 3/124* (2013.01)

(58) Field of Classification Search

CPC ..... F42B 3/11; F42B 3/124

See application file for complete search history.

(56) References Cited

U.S. PATENT DOCUMENTS

| | | | | |
|---|---|---|---|---|
| 3,351,012 A * | 11/1967 | Wilson | F42C 19/14 102/202.7 |
| 7,574,960 B1 * | 8/2009 | Dockery | F42B 3/12 102/202.7 |
| 10,234,248 B1 * | 3/2019 | Hoang | F42C 11/02 |

FOREIGN PATENT DOCUMENTS

| | | | |
|---|---|---|---|
| EP | 1022536 A1 * | 7/2000 | B60R 21/272 |
| EP | 2626256 B1 * | 8/2016 | B21K 23/00 |

* cited by examiner

*Primary Examiner* — Bret Hayes

(74) *Attorney, Agent, or Firm* — Patenttm.US

(57) ABSTRACT

The invention proposes the design of a pyrotechnic initiator applied in the aerospace field, including three main components: the housing, the burning bridge and the pyrotechnic dose. The housing has a protective effect and increases the power of the pyrotechnic dose, in which the number of threads and the thread length are calculated to ensure to withstand the fire pressure. The burning bridge generates heat to ignite the ignition dose, the diameter of the bridge is calculated to ensure the resistance of the burning bridge. The pyrotechnic dose consists of 3 ingredient doses, which are the ignition dose, the intermediate dose, and the fire-boosting dose. In which, the mass, composition and density of the doses are calculated to ensure that the required working pressure is created.

4 Claims, 1 Drawing Sheet

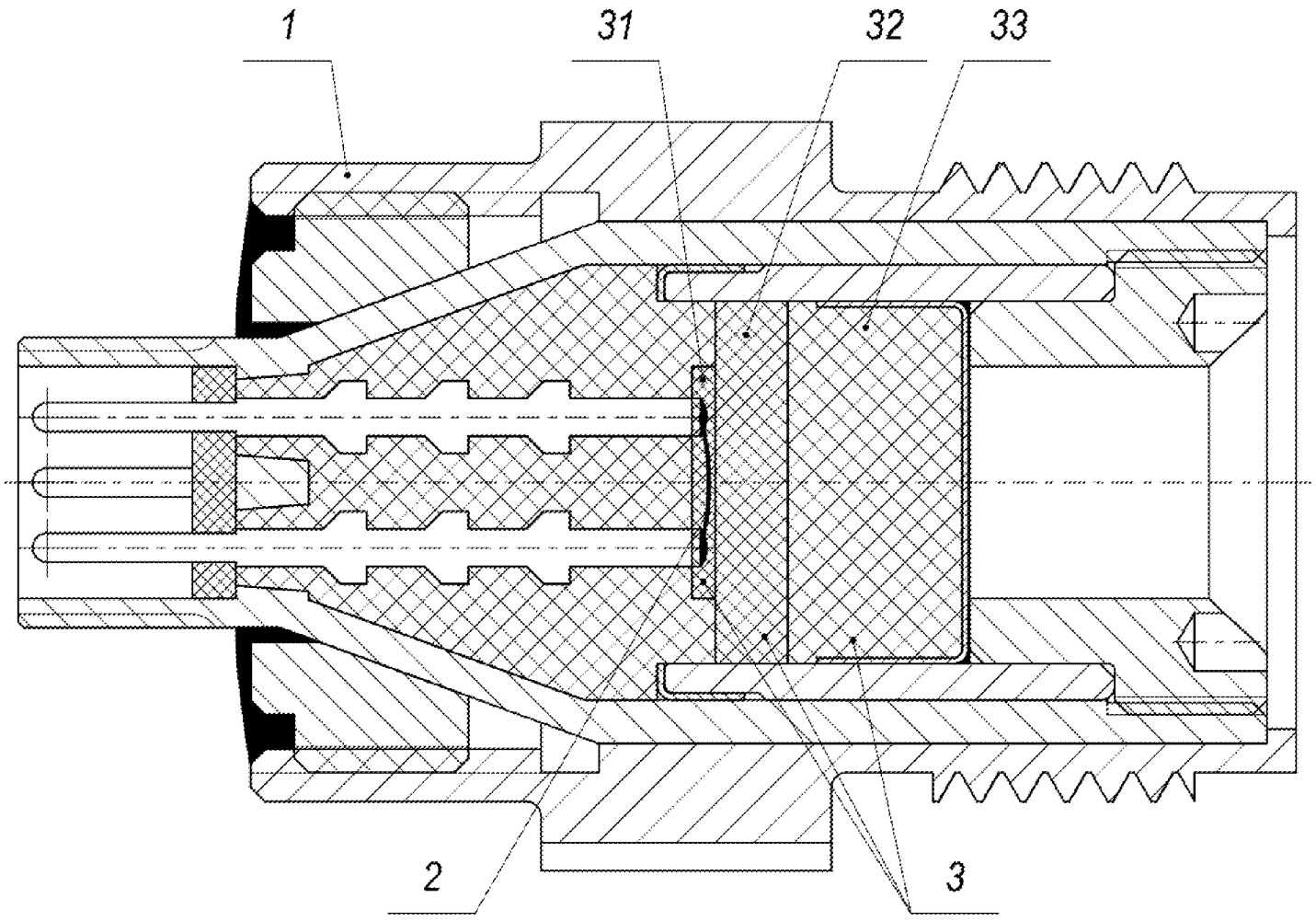
33
32
31
1
3
2

PYROTECHNIC INITIATOR DEVICE

THE TECHNICAL FIELD OF THE INVENTION

The invention proposes a pyrotechnic initiator. The pyrotechnic initiator mentioned in the invention is applied in the aerospace field such as thrusting the escape systems for pilots, aircraft, the overhead starter system for gas turbine engines, gas pipeline systems on flying instruments.

THE TECHNICAL STATUS OF THE INVENTION

Pyrotechnic initiators are widely used in aerospace fields such as equipment in civilian aircraft escape systems, fighter pilots escape systems, starter systems, jet engine fuels diversion systems, insurance mechanisms of military weapons . . . . The initialization and start-up process in the above systems plays a very important role requiring high reliability and short start-up times.

U.S. Pat. No. 4,978,089 of Dec. 18, 1990 describes an aircraft emergency escape system. In the text, the author proposes a system to open an emergency exit on the fuselage, including a pyrotechnic device placed in the fuselage capable of opening an emergency exit on the body, a fire-activated device. Activated by an initiator, the starter is controlled by a safety manometer that senses the pressure inside and outside the aircraft. When the difference between the pressure inside and outside the aircraft is greater than a specified value, the starter is inhibited, and when the pressure difference is below the specified threshold, the generator will be activated, ignite the flamethrower device, creating pressure on the quick opening of the fuselage.

U.S. Pat. No. 6,935,655 of Aug. 30, 2005 describes a safe airbag start system in a car. In the text, the author proposes a pyrotechnic initiator to start the airbag. When the vehicle is in a collision, the main control system controls the collision, acceleration, and speed sensors to detect the impact. When the acceleration exceeds the specified value, an electrical signal is fed into the initiator for a very short time to ignite the ignition and gas generators to produce large quantities of gas in a short time. Finally, the airbag is inflated to reduce the impact on the occupants.

U.S. Pat. No. 8,216,401 of Jul. 10, 2012 describes a device that ignites. In the text, the author proposes that pyrotechnic device includes 3 main components: Burning bridge, acceptor and out put. In which the dose of primer was improved by using a 4.6-dinitro-7-hydroxybenzofuroxan unleaded material instead of conventional lead styphnate along with a mixture of heat-sensitive substances, oxidants, fuels and binders. The device operates when voltage is applied to the base of the burning bridge.

The above inventions have applied pyrotechnic initiated equipment in many fields, but the inventions have not yet given detailed design calculations. Therefore, this invention proposes to compute the design of a pyrotechnic initiator for the application in the aerospace field.

THE TECHNICAL NATURE OF THE INVENTION

The purpose of the invention is that a pyrotechnic initiator is used in the aerospace field, in particular in systems requiring high reliability, fast start-up times.

To achieve the above purpose, the invention calculates the design of a pyrotechnic initiator consisting of the main components: the housing, the burning bridge and the pyrotechnic dose.

The housing is a part that protects and increases the power of the pyrotechnic charge, so it can not react to the charge, withstand the pressure of stuffing (stuffing pressure is the pressure acting on the housing during the dosing pyrotechnic process), resistant to corrosion (corrosion is the deterioration of a material through its interaction with surroundings environment over time); therefore must it be precisely machined and have the required mechanical strength (mechanical strength is the ability of the material to resist the destruction of mechanical forces, in the case of the invention the device must withstand pressure capacity not less than 693 kG/cm$^2$); the housing is connected by thread with other parts. Therefore, the invention uses stainless steel 09X16H4 to manufacture the housing of the initiator.

The number of threads on the housing is determined by the tensile and shear strength (tensile strength and shear strength are the highest values of tensile and subsequent stresses that the material can withstand, when applied, if the stresses exceed this limit, there will be local deformation and then damage) according to the formula:

$$n_k = \frac{P \cdot d}{k_k \cdot s \cdot [\sigma_k]}; n_c = \frac{P \cdot d}{k_c \cdot s \cdot [\tau]}$$

In which: $\sigma_k$, $\tau$ is the tensile and shear strength of the material ($\sigma_k$=6750 kG/cm$^2$; $\tau$=5200 kG/cm$^2$ with stainless steel 09X16H4); $k_k$, $k_c$ is the safety coefficients (when calculated by tensile strength $k_k$=1.57; by shear strength $k_c$=2); s is a pitch, s=0.15 cm; d is a mean diameter of a thread (~2.1 cm); P is an average pressure, P=693 kG/cm$^2$, $n_k$ is a tensile strength, $n_c$ is a shear strength of the housing.

Therefore, the optimal number of threads on the initiator housing is 6 threads.

The burning bridge is a part with the function of generating heat to ignite the ignition dose, requiring a large resistivity and not being greatly changed when activated; the burning bridge must ensure mechanical durability and should not react to the dose. The burning bridge can be made of several alloys such as Platinum-Iridium, Ni—Cu alloy, Ni—Cr alloy.

The diameter of the burning bridge is determined by the formula:

$$R = \rho \frac{l}{S} = \rho \frac{4l}{\pi d^2}$$

In which: R—Resistance of the pyrotechnic initiator (average value ~0.9Ω); ρ—The resistivity of the burning bridge; 1—Length of the burning bridge ($2.4 \cdot 10^{-3}$ m); d—Diameter of the burning bridge (R and 1 value are calculated according to the working and design requirements of each equipment).

Therefore, the optimal calculated burning bridge diameter is 0.04 mm.

The composition of the pyrotechnic dose of the initiator includes:

Ignition class: Oxidant $CuO_2$—60%; Ignition substances Zr—40%; cotton bonding powder $NO_3$—2%. The weight is 0.12 g; density 2.5 g/cm$^3$.

Intermediate class: Potassium perchlorate $KClO_4$—50%; Lead rodanite $Pb(CNS)_2$—47%; Barium chromate $BaCrO_4$—3%; NC glue ($C_{24}H_{31}N_9O_{38}$)—1%. The weight is 0.25 g; density 1.45 g/cm$^3$.

Fire-boosting class: Potassium perchlorate $KClO_4$—64%; aluminum powder—31%; NC glue ($C_{24}H_{31}N_9O_{38}$)—5%. The weight is 0.4 g; density 1.23 g/cm$^3$.

BRIEF DESCRIPTION OF THE DRAWING

FIG. 1 illustrates the structure of the pyrotechnic initiator.

DETAILED DESCRIPTION OF THE INVENTION

As shown in FIG. 1, the FIGURE illustrates the main mechanisms of the pyrotechnic initiator. It includes housing 1, burning bridge 2, pyrotechnic dose 3. In which:

The housing 1 has the effect of protecting and increasing the power of the pyrotechnic charge, so it must satisfy the following requirements: not to react to the pyrotechnic charge; withstand stuffing pressure; resistant to corrosion; must be precision machined and have the required mechanical strength. From there we choose the stainless steel 09X16H4 which is a high-tech and mechanical steel, the steel is heated to temperature at 1052° C. and the next aging at 482° C. to secrete the dispersion phases to make the durability of steel can reach 1654 MPa. Steel is used for applications requiring high strength, resistance to corrosion, typically in aircraft structures.

The housing is connected by thread with other parts so the calculation of the number of threads to ensure maximum allowable effect to the thread when the device operates, the thread must be durable.

Maximum permissible force applied to the thread (Fmax):

$$F_{max} = \frac{\pi d^2}{4} P$$

In which: d—Diameter of the thread (~2.1 cm); P—Average (693 kG/cm$^2$).

Pitch: s=0.15 cm.

The number of threads is determined from the tensile strength ($n_k$) and shear strength ($n_c$):

$$n_k = \frac{P \cdot d}{k_k \cdot s \cdot [\sigma_k]};\ n_c = \frac{P \cdot d}{k_c \cdot s \cdot [\tau]}$$

In which: $\sigma_k$, $\tau$ is the tensile and shear strength of the material ($\sigma_k$=6750 kG/cm$^2$; $\tau$=5200 kG/cm$^2$ with stainless steel 09X16H4); $k_k$, $k_c$ is the safety coefficients (when calculated by tensile strength $k_k$=1.57; by shear strength $k_c$=2); s is a pitch, s=0.15 cm; d is a mean diameter of a thread (~2.1 cm); P is an average pressure, P=693 kG/cm$^2$, $n_k$ is a tensile strength, $n_c$ is a shear strength of the housing.

The actual selected number of the threads is:

$$n=1{,}5 \cdot n_{max}(n_k;n_c)+4$$

Therefore, the number of the threads on the housing is 6. Thread length (10:

$$l_r=n \cdot s$$

In which: n—number of the threads; s—pitch.

Therefore: $l_r$=6·0.15=0.9≈1 cm.

The burning bridge 2 generates heat to ignite the Ignition class. The accumulation process begins with the conversion of electricity into heat. The burning bridge must satisfy the following requirements: having high resistivity; must not melt; resistant to corrosion; ensure mechanical strength; do not react to the dose; there is no major resistance changed when activated.

TABLE 3

Main parameters of some alloys used as burning bridge.

| Material | ρ (300° C.) (Ω · mm$^2$/m) | C (Cal/g · ° C.) | γ (g/cm$^3$) | Cγ/ρ | $T_{nc}$ (° C.) |
|---|---|---|---|---|---|
| Platinum - Iridium (85% Pt + 15% Ir) | 0.36 | 0.032 | 21.6 | 1.92 | 1800 |
| Ni—Cu Alloy | 0.485 | 0.098 | 8.9 | 1.80 | 1260 |
| Ni—Cr Alloy (80% Ni + 20% Cr) | 1.19 | 0.11 | 8.4 | 0.78 | 1410 |

The resistance of pyrotechnic initiator is determined by the formula:

$$R = \rho \frac{l}{S} = \rho \frac{4l}{\pi d^2}$$

In which: R—Resistance of the pyrotechnic initiator (average value—0.9Ω); ρ—The resistivity of the burning bridge; 1—Length of the burning bridge ($2.4 \cdot 10^{-3}$ m); d—Diameter of the burning bridge.

According to the sensitivity and economy of the pyrotechnic initiator, we choose Ni—Cu alloy as the burning bridge wire, the wire size is calculated by the formula:

$$d = \sqrt{\frac{4\rho l}{\pi R}} = \sqrt{\frac{4 \cdot 0.49 \cdot 2.4 \cdot 10^{-3}}{3.14 \cdot 0.9}} = 0.040 \text{ mm}$$

Principle of operation: The device works when voltage is applied to the burning bridge, the current will heat up the burning bridge and burn the combustible component in the Ignition class, burning the intermediate class and fire-boosting class, fire-boosting dose will generate heat and pressure to work.

pyrotechnic dose 3: The doses are the main element to create fire, heat and pressure. Pyrotechnic dose includes ignition dose 31, intermediate dose 32, fire-boosting dose 33. The volume, density, component rate of pyrotechnic dose for device is calculated according to the details below:

+ Calculate fire-boosting dose 33 a – Calculate the composition of the dose

The fire-boosting dose needs a relatively short burning time, can create heat and pressure in this time, so we choose the mixture Al—$KClO_4$—NC as the fire-boosting dose.

TABLE 1

Properties of fire-boosting dose Al—$KCLO_4$—NC

| Fire-boosting dose | Density ($g/cm^3$) | Ignition Temperature (° C.) | Burning temperature (° C.) | Ability to generate heat (Cal/g) | Heat to burn (Cal/g) | Ability to generate performance (at · $cm^3$/g) |
|---|---|---|---|---|---|---|
| Al—$KClO_4$—NC | 2.46 | 754 | 5223 | 2000 | 3.45 | 5396 |

Calculate the oxygen balance for each 1 g dose as follows:

Oxidizing agent ($KClO_4$): +0.462

Ignition substance (Al aluminum powder): −0.890

Binder (adhesive NC $C_{24}H_{31}N_9O_{38}$): −0.387.

Assume that the Al ratio is x, the $KClO_4$ rate is y and the $C_{24}H_{31}N_9O_{38}$ rate is z (5%)

$$y=100-5-x=95-x$$

The algebraic sum of oxygen at the respective proportions of each component must be zero.

Therefore: 0,462·(95−x)−0.89x−(0.387·5)=0 x=31(%); y=64(%); z=5(%)

Therefore, the composition of the fire-boosting dose is as follows: $KClO_4$—64%; Al—31%; $C_{24}H_{31}N_9O_{38}$—5%.

+ Calculate dose density

With the density and proportion of the given compositions, the density of the dose powder can be calculated by the formula:

$$q_{max} = \frac{100}{\frac{x_1}{q_1} + \frac{x_2}{q_2} + \ldots + \frac{x_n}{q_n}} \quad (31)$$

In which: $x_1, x_2, \ldots x_n$—the proportion of compostions (%); $q_1, q_2, \ldots q_n$—density of compositions ($g/cm^3$).

$q=K_c \cdot q_{max}$; $K_c$—compression coefficient (40-60% of $q_{max}$), take $K_c$=0.5

The density of the compositions is as follow: Al—2.72 $g/cm^3$; $KClO_4$—2.52 $g/cm^3$; $C_{24}H_{31}N_9O_{38}$—1.60 $g/cm^3$.

Following the formula (31): $q_{max}$=2.46 $g/cm^3$; q=0.5·2.46=1.23 $g/cm^3$.

c—Calculate the mass

The mass of the fire-boosting dose required co should be sufficient to produce the required pressure P.

P pressure is calculated by the formula:

$$P = \frac{f}{(V/\omega)-1} \cdot Do\text{đ}o' : \omega = \frac{V}{1+\frac{f}{P}}$$

In which: ω—mass of the fire-boosting dose (g); P—burning pressure ($kG/cm^2$); V—volume of combustion chamber ($cm^3$); f—dose force (at·$cm^3$/g).

We have P=450 $kG/cm^2$ (value according to the standards), V=5 $cm^3$, f=5396 at·$cm^3$/g then ω=0.4 g.

+ Calculate the intermediate dose 32 a − Calculate the composition of the dose

Intermediate dose 32 works to increase the ability to reliably ignite the fire-boosting dose from the initial heat pulse generated by the ignition dose. Intermediate dose 32 lies between ignition dose 31 and increased flame dose 33. We choose a mixture of $Pb(CNS)_2$—$KCLO_3$—$BaCrO_4$—NC (has good ignition ability and high burning temperature to ensure reliable ignition fire-boosting dose) as an intermediate dose.

TABLE 2

Properties of intermediate dose $Pb(CNS)_2$—$KCLO_3$—$BaCrO_4$—NC

| Intermediate dose | Ignition temperature (° C.) | Burning temperature (° C.) | Heat to burn (Cal/g) | Ability to generate performance (at · $cm^3$/g) |
|---|---|---|---|---|
| $Pb(CNS)_2$—$KCLO_3$—$BaCrO_4$—NC | 205 | 2618 | 3.87 | 3824 |

Calculate the oxygen balance for each 1 g dose as follows:

$Pb(CNS)_2$: −0.395

$KCLO_3$: +0.392

$BaCrO_4$: +0.125

Assume that the $Pb(CNS)_2$ ratio is x, the $KClO_3$ rate is y and the $BaCrO_4$ rate is z (3%).

$$y=100-3-x=97-x$$

The algebraic sum of oxygen at the respective proportions of each component must be zero.

Therefore: 0.392·(97−x)−0.395x+0.125.3=0 x=50(%); y=47(%); z=3(%)

Therefore, the composition of the intermediate dose is as follows: $Pb(CNS)_2$—47%; $KCLO_3$—50%; $BaCrO_4$—3%; NC glue ($C_{24}H_{31}N_9O_{38}$)—1% (external calculation).

b—Calculate the mass

The limited mass (G) of the intermediate dose is calculated by the formula:

$$G = q_{gh}\frac{\pi d_{ch}^2}{4} \tag{32}$$

In which: $q_{gh}$—Limited mass of intermediate dose per 1 $cm^2$ surface area; $d_{ch}$-diameter of intermediate dose.

We have: $q_{gh}$=0.2 g and $d_{al}$=1.25 cm so G=0.25 g.

c—Calculate the density

The density of the compositions: $KClO_3$—2.32 ($g/cm^3$); $Pb(CNS)_2$—3.82 ($g/cm^3$); $BaCrO_4$—4.498 ($g/cm^3$).

According to the formula (31): $q_{max}$=2.9 ($g/cm^3$); q=0.5·2.9=1.45 ($g/cm^3$).

+ Calculation of ignition dose 31

The ignition dose should be easily burned by the initial heat impulse, has a high fire sensitivity and also has a large heat. We choose the $CuO_2$—Zr—$NO_3$ mixture as the ignition dose.

The composition and rate of the ignition dose are as follows: Oxidizing agent $CuO_2$—60%; ignition substances Zr—40%, cotton adhesive powder $NO_3$—2%.

The limited mass (G) of the ignition dose is calculated by the formula (32):

In which: $q_{gh}$=0.1 g and $d_{ch}$=1.25 cm so G=0.12 g.

Weight, density and size of ignition dose should be selected, ignition dose density is within 2.5 $g/cm^3$.

+ Calculate the combustion pressure generated in a standard volume chamber

The pressure when the dose burns in the closed volume is calculated by the formula:

$$P = \frac{f\Delta}{1-\alpha\Delta} \tag{33}$$

In which: f—dose force ($at\cdot cm^3/g$); Δ—dose density ($g/cm^3$); α—cumulative coefficient ($cm^3/g$).

The force of the dose (f) is calculated by the formula:

$$f=n.R.T \tag{34}$$

In which: n—the number of moles of the gas produced; R—gas constant; T—burning temperature.

The number of moles of gas produced can be calculated according to the reaction of the fire-boosting dose:

$$3KClO_4+8Al=3KCl+4Al_2O_3$$

$$C_{24}H_{31}N_9O_{38}=4.6CO_2+19.4CO+9.4H_2O+4.5N_2+6.1H_2$$

The number of moles of gas generated when 1 kg of fire-boosting dose is burned is:

$$N = \frac{n'\cdot 1000}{N_1M_1+N_2M_2+\ldots+N_xM_x} = \frac{7.950}{3.139+8.27}+\frac{44.50}{1053} = 12.6\ \text{mol/kg}$$

Burning temperature T=5223° C.

Gas constant R=0.082 (at/° C.mol).

From there, according to formula (34) we have: f=5396 ($at\cdot cm^3/gf$).

The dose density (Δ) is calculated by the formula:

$$\Delta = \frac{\omega}{V}$$

In which: ω—effective mass of the dose (g); V—volume of the combustion chamber ($cm^3$).

Effective mass of the dose (ω): Liều tang lira: 0.4 g (f=5396 $at\cdot cm^3/gf$); intermediate dose: 0.25 g (f=2500 $at\cdot cm^3/gf$); ignition dose: 0.12 g (f=4609 $at\cdot cm^3/gf$).

From that:

$$\omega = 0.4+0.25\cdot\frac{2500}{5396}+0.12\cdot\frac{4609}{5396} \approx 0.62\ \text{g}$$

Volume of the combustion chamber: V=5 $cm^3$.

So the dose density:

$$\Delta = \frac{0.62}{5} = 0.124\text{g}/\text{cm}^3.$$

Cumulative coefficient (α):

$\alpha=0.001\cdot\gamma_0$.

In which: $\gamma_0$—Specific volume of ignition dose ($cm^3/g$)

$$\gamma_0 = \frac{22.4\cdot n'\cdot 1000}{N_1M_1+N_2M_2+\ldots+N_xM_x}$$

$$\gamma_0 = 22.4\cdot 12.6 = 282\ \text{cm}^3/\text{g}$$

$$\alpha = 0.001\cdot 282 = 0.282\ \text{cm}^3/\text{g}.$$

Calculate P by the formula (33):

$$P = \frac{5396\cdot 0.124}{1-0.282\cdot 0.124} = 693\ \text{kG}/\text{cm}^2$$

Therefore, the actual combustion pressure is greater than the standard pressure (450 $kG/cm^2$) to ensure that the initiator's working requirements are met.

In summary, the composition of the doses is as follows:

+ Ignition class: Oxidizing agent $CuO_2$—60%; ignition substances Zr—40%; $NO_3$—2% cotton bonding powder. The weight is 0.12 g; density 2.5 $g/cm^3$.

+ Intermediate class: potassium perchlorate $KClO_4$—50%; lead rodanite $Pb(CNS)_2$—47%; barium chromate $BaCrO_4$—3%; NC glue ($C_{24}H_{31}N_9O_{38}$)—1%. The weight is 0.25 g; density 1.45 $g/cm^3$.

+ Fire-boosting class: potassium perchlorate $KClO_4$—64%; aluminum powder—31%; NC glue ($C_{24}H_{31}N_9O_{38}$)—5%. The weight is 0.4 g; density 1.23 g/cm$^3$.

The invention is described in detail as above. However, clearly that to the average person knowledgeable in the field of invention is not limited to the variant described in the invention description. An invention can be made in a modified or altered mode that is not outside the invention scope defined by the points of claim protection. Therefore, what is described in the invention description is for illustrative purposes only, and will not impose any restrictions on the invention.

What is claimed is:

1. A pyrotechnic initiator comprising: a housing, a burning bridge and a pyrotechnic charge:

wherein the housing protects and increases power of the pyrotechnic charge, the housing is not reactive to the pyrotechnic charge, withstand the pressure of stuffing, and resistant to corrosion; the housing is connected by a number of threads with other parts; the housing comprising a stainless steel 09X16H4;

the number of threads is determined from tensile strength ($n_k$) and shear strength ($n_c$) by the formula:

$$n_k = \frac{P \cdot d}{k_k \cdot s \cdot [\sigma_k]};\ n_c = \frac{P \cdot d}{k_c \cdot s \cdot [\tau]}$$

in which: $\sigma_k$, $\tau$ is a tensile and shear strength of the material, $\sigma_k$=6750 kG/cm$^2$; $\tau$=5200 kG/cm$^2$ with stainless steel 09X16H4; where $k_k$, $k_c$ each comprise a safety coefficient, when calculated by tensile strength $k_k$=1.57; by shear strength $k_c$=2; s is a pitch, s=0.15 cm; d is a mean diameter of a thread, ~2.1 cm; P is an average pressure, P=693 kG/cm$^2$, $n_k$ is a tensile strength, $n_c$ is a shear strength of the housing;

the number of the threads is:

$$n=1.5 \cdot n_{max}(n_k;n_c)+4$$

therefore, the number of the threads on the housing is 6; thread length ($l_r$):

$$l_r=n \cdot s$$

in which: n—the number of the threads; s—the pitch;

therefore: $l_r$=6 times 0.15=0.9≈1 cm;

the burning bridge generates heat to ignite the ignition charge, requiring a large resistivity and not being substantially changed when activated;

a diameter of the burning bridge is determined by the formula:

$$R = \rho\frac{l}{S} = \rho\frac{4l}{\pi d^2}$$

in which: R—resistance of the pyrotechnic initiator, average value 0.9Ω; ρ—the resistivity of the burning bridge; l—length of the burning bridge 2.4.10$^{-3}$ m; d—diameter of the burning bridge;

an optimal calculated burning bridge diameter is 0.04 mm;

the pyrotechnic charge of the initiator includes:

ignition class: oxidizing agent $CuO_2$—60%; ignition substance Zr—40%; cotton binder powder based $NO_3$—2%; having a mass that is 0.12 g; density 2.5 g/cm$^3$;

intermediate class: potassium perchlorate $KClO_4$—50%; lead rodanite $Pb(CNS)_2$—47%; barium chromate $BaCrO_4$—3%; NC glue ($C_{24}H_{31}N_9O_{38}$)—1%; having a mass that is 0.25 g; density 1.45 g/cm$^3$;

fire-boosting class: potassium perchlorate $KClO_4$-64%; aluminum powder—31%; NC glue ($C_{24}H_{31}N_9O_{38}$)—5%; having a mass that is 0.4 g; density 1.23 g/cm$^3$.

2. The pyrotechnic initiator according to claim 1, wherein the burning bridge is made of platinumi-iridium.

3. The pyrotechnic initiator according to claim 1, wherein the burning bridge is made of Ni—Cu alloy.

4. The pyrotechnic initiator according to claim 1, wherein the burning bridge is made of Ni—Cr alloy.

* * * * *